US007650947B2

(12) United States Patent
Henke et al.

(10) Patent No.: US 7,650,947 B2
(45) Date of Patent: Jan. 26, 2010

(54) ONE TRIP SYSTEM FOR CIRCULATING, PERFORATING AND TREATING

(75) Inventors: Joseph Albert Henke, Lewisville, TX (US); Keith Alan Maxey, Tye, TX (US); Charles Wayne Harrell, Graham, TX (US)

(73) Assignee: Titan Specialties, Ltd., Pampa, TX (US)

( * ) Notice: Subject to any disclaimer, the term of this patent is extended or adjusted under 35 U.S.C. 154(b) by 358 days.

(21) Appl. No.: 11/712,188

(22) Filed: Feb. 28, 2007

(65) Prior Publication Data

US 2008/0202755 A1 Aug. 28, 2008

(51) Int. Cl.
*E21B 19/16* (2006.01)
*E21B 17/10* (2006.01)
*E21B 29/02* (2006.01)

(52) U.S. Cl. ..... 166/380; 166/242.6; 166/297

(58) Field of Classification Search ..... 166/297–299, 166/369–387, 170, 55, 177.5, 242.6, 308.1, 166/308.2; 175/1–4.6, 107
See application file for complete search history.

(56) References Cited

U.S. PATENT DOCUMENTS

| | | | | |
|---|---|---|---|---|
| 2,340,966 | A * | 2/1944 | Kitsman | 175/4.55 |
| 4,249,609 | A * | 2/1981 | Haafkens et al. | 166/308.2 |
| 4,901,802 | A * | 2/1990 | George et al. | 175/4.52 |
| 5,103,912 | A * | 4/1992 | Flint | 166/297 |
| 6,536,524 | B1 | 3/2003 | Snider | |
| 6,912,933 | B2 * | 7/2005 | Knopp et al. | 81/57.39 |
| 6,962,202 | B2 | 11/2005 | Bell et al. | |
| 6,962,203 | B2 * | 11/2005 | Funchess | 166/297 |
| 7,467,671 | B2 * | 12/2008 | Savignat et al. | 175/57 |

* cited by examiner

*Primary Examiner*—Jennifer H Gay
*Assistant Examiner*—Kipp C Wallace
(74) *Attorney, Agent, or Firm*—W. Allen Marcontell

(57) ABSTRACT

A well completion method and apparatus comprises a pipe string having a bottom attached boring bit and scraper. Above the bit at designated well fluid production locations, perforation assemblies are integrated into the pipe string. Each perforation assembly comprises a by-pass circulation mandrel and a perforation gun. The circulation mandrel is secured at opposite distal ends in threaded Y-adapter boxes. The perforating gun is secured in collar bores respective to the opposite end Y-adapters.

9 Claims, 9 Drawing Sheets

ONE TRIP SYSTEM FOR CIRCULATING, PERFORATING AND TREATING

CROSS-REFERENCE TO RELATED APPLICATION

NA

BACKGROUND OF THE INVENTION

Field of the Invention

The traditional prior art procedure for completing some gas wells after a well casing is set and cemented in place, is to run into the wellbore with a "bit and scraper" attached to the bottom of a tubing or drill string and "clean out" the well. First, a bore wall scraping or reaming tool is attached to the end of a pipe string. The pipe string is lowered into the well while the scraping tool is rotating. At or near the bottom of the well, the bit may encounter a plug of cement within the casing bore which is the residual of the cementing operation that secures the well casing to raw borewall. Following the scraping and boring process, clean fluid is circulated down the tubing bore and up through the tubing/casing annulus for flushing the well of debris created by the bit and scraper. After the well is circulated clean, this pipe string is pulled from the wellbore.

Next, a perforating gun assembly is attached to the end of a pipe string and run into the wellbore. The perforating gun or guns are positioned across from the geologic formation zones of interest for fluid production and discharged. There are several types of perforation methods including shaped charges, ballistic (projectiles) and chemicals. All types, however, have the objective of perforating the well casing, the surrounding cement collar and a short distance into the geologic formation. The purpose of such perforations is to facilitate an extractive flow of in situ formation fluid into the bore of the well casing and ultimately to the wellhead at the surface.

In many cases, after the perforating guns are detonated and holes are made through the casing and out into the formation, a "frac-treatment" on the formation is performed. The "frac-treatment" may consist of pumping some type of acid down the wellbore and out through the casing perforations under pressure into the formation to dissolve fines and other debris for enhancing in situ formation fluid production. Also characterized as frac-treatment are "proppants" which are liquid/particulate mixtures that are pumped down the well under high pressure and driven into the fracture channels to prevent subsequent closure. Any of these processes normally take a minimum of two complete "trips" into the wellbore to bottom.

Traditionally, a "trip" is defined as that process of assembling a tubing or drill string into a borehole or wellbore, incrementally, in approximately 90 ft. "stand" sections of pipe comprising three "joints" of about 30 ft. each. In this specification, the terms "pipe" and "tubing" will be used interchangeably. This incremental assembly process is performed manually on the derrick or rig floor as the accumulated length of assembled pipe is lowered into the wellbore. Assembly continues until the bottom end of the pipe or tubing string reaches the bottom of the wellbore. For a typical, 3,000 ft. well, this requires about 33 stands of pipe or tubing and 32 stand connections. Many land wells are 7,000 ft. deep and a few exceed 20,000 ft. Off-shore wells frequently exceed 20,000 ft. of deviated direction penetration length. A skilled rig crew can assemble a 3,000 ft. tubing string in about two to two and one half hours. Extraction of the tubing string requires about the same amount of time. Accordingly, a "round trip" into and out of a wellbore by a minimum rig crew of four requires about five to five and one half hours of strenuous manual labor; assuming no difficulties are encountered. Ergo, any procedure, process or equipment that promises to save the time of even one "trip" in the well completion process is highly valued.

SUMMARY OF THE INVENTION

The pipe string assembly of the invention includes a series of end-to-end connected joints of conventional drill pipe or production tubing having a reaming or scraper bit secured onto the lower distal end of the string. Above the bit at selected locations among the serial string of conventional pipe joints are perforation assemblies according to the invention.

Each perforation assembly comprises a first Y-adapter at the upper distal end for transition of an internal fluid flow channel from a conventional pipe bore into a circulation mandrel of the perforation assembly. At the lower distal end of the perforation assembly is a second Y-adapter for transition of the fluid flow channel from the circulation mandrel into another pipe bore or a successive perforation assembly connected by a nipple sub. Extending between the opposite end Y-adapters in adjacent parallelism with the assembly circulation mandrel is an angularly oriented, well pressure actuated, casing perforation gun.

The perforating gun comprises a gun body tube that houses a shaped charge loading tube within an internal bore of the body tube. The shaped charge loading tube confines a plurality of shaped charge explosive cells connected to a detonator cord that extends the length of the gun body tube. At one end of the gun body tube bore is a pressure firing head assembly. One end of the detonating cord is secured to the pressure firing head assembly.

Each Y-adapter also includes a receptacle collar for radially confining respective ends of the perforation gun. Locking collars threaded along end elements of the perforation gun are turned tightly against opposite faces of the Y-adapter receptacle collar to clamp the gun from movement in opposite axial directions. The angular orientation of the gun about the gun axis is secured by one or more cap screw heads. The cap screw shafts are turned into the perforating gun whereas the cap screw heads project into apertures in the respective receptacle collar.

The invention string assembly as described above is lowered into the well while rotating to facilitate the bit and scraper operation on any residual cement or cutting debris. As the bit attains bottom hole, clean well fluid is pumped down the pipe string and circulation mandrels, through the drill bit orifices and up the wellbore annulus between the string assembly and the inside casing wall. This circulation continues until the operator feels the well has been sufficiently flushed of debris.

Once the wellbore is circulated over to clean fluid, a predetermined pressure is applied to the wellbore to shear the pins that restrain the firing pin in the pressure firing heads. This begins a chain of events resulting in the detonation of the detonating cord. Progressive ignition of the detonating cord sequentially ignites the shaped charges to penetrate the casing at points contiguous with the well fluid production zone(s).

Following the casing perforation, the well may be immediately frac-treated by pumping down the completion pipe string and into the well annulus the essential fracturing chemical or sand mixture.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

Apparatus Construction and Assembly

Figure 1:
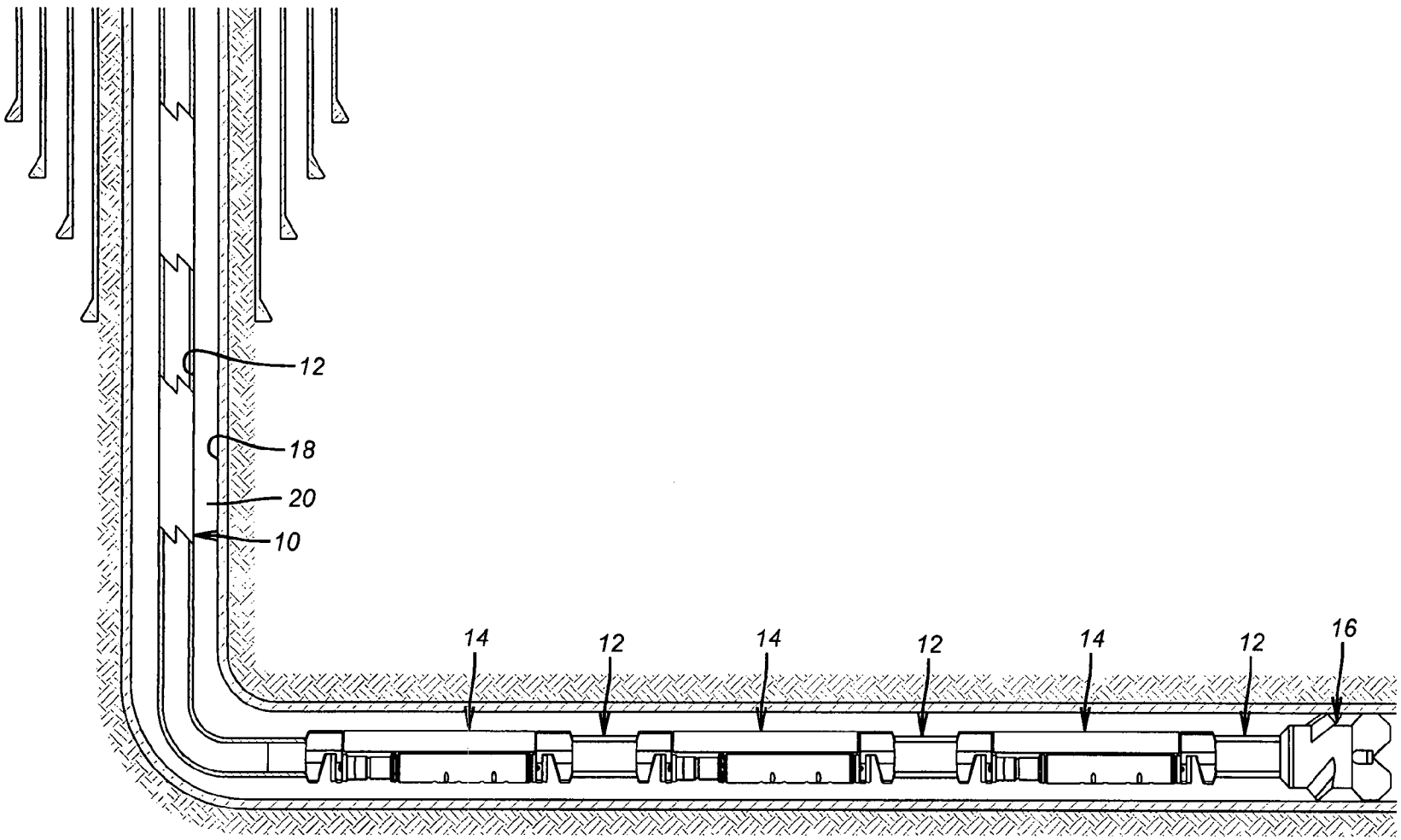
FIG. 1 is a schematic of a cased borehole having the present invention pipe string in place.

The configuration of the present well completion apparatus is represented by the pipe string 10 of FIG. 1. The bottom end of the pipe string is terminated by a scraper and reaming bit 16 having a functional capacity for scraping or cutting debris and other foreign irregularities from the interior bore wall and bottom end of a wellbore casing 18. Traditionally, a scraper bit 16 comprises an interior fluid flow path that channels drilling fluid from the internal bore of a drive pipe or tube 12 for high velocity discharge against the bit end-cutting elements. This high velocity discharge impacts the teeth or other cutting elements of the bit to flush them free of cutting debris and flow the loose debris up the wellbore annulus 20 between the exterior surfaces of the drive tube 12 and the interior surface of the casing 18.

Hereafter, the term "drilling" fluid is used to characterize any fluid originating from a pump or compressor at or near the earth's surface. It may be "clean" water or a more complex liquid such as mixtures of water and clay (common drilling fluid) or emulsions of refined petroleum. In certain cases, the fluid may be a gaseous vapor such as steam, a true gas such as nitrogen or a molecular mixture of gases such as "natural gas". The term "tube" is used to designate a tubular structural component that links the bit 16 to the surface for fluid and power transmission whether characterized as a production tube or drill pipe.

The assembled continuity of the drive tube 12 from the rig floor (not shown) down to the bit 16 is interrupted at selected locations by insertion of perforation assemblies 14. These perforation assemblies 14 are operative to accomplish two basic functions: a) to perforate the casing 18 and surrounding cement sleeve and b) to provide a drilling fluid flow path around a perforation gun assembly 34. The perforation assemblies 14 are positioned along the length of the pipe string for adjacent alignment with the location of a geologic strata deemed suitable for extracting the in situ well fluids. Such geologic strata are characterized herein as "production zones". There may be a plurality of such strata traversed by the wellbore. Hence, there may be a corresponding plurality of perforation assemblies 14. Moreover, there may be a plurality of closely coupled perforation assemblies 14 positioned in the pipe string 10 for perforating a single production zone. Frequently, The perforation assemblies are positioned in the pipe string 10 relative to the bit 16. The location of the production zones along the wellbore length from the wellbore bottom is known to the driller. Hence, when the bit is at or near the wellbore bottom, the perforation assemblies will align adjacently with the desired perforation zones. There are other methods, however, for locating a specific perforation assembly 14 adjacent a specific well fluid production zone. The exact method of locating perforation assemblies 14 along the length of the pipe string 10 will depend on the method desired by the driller for locating the pipe string along the length of the wellbore.

Figure 2:
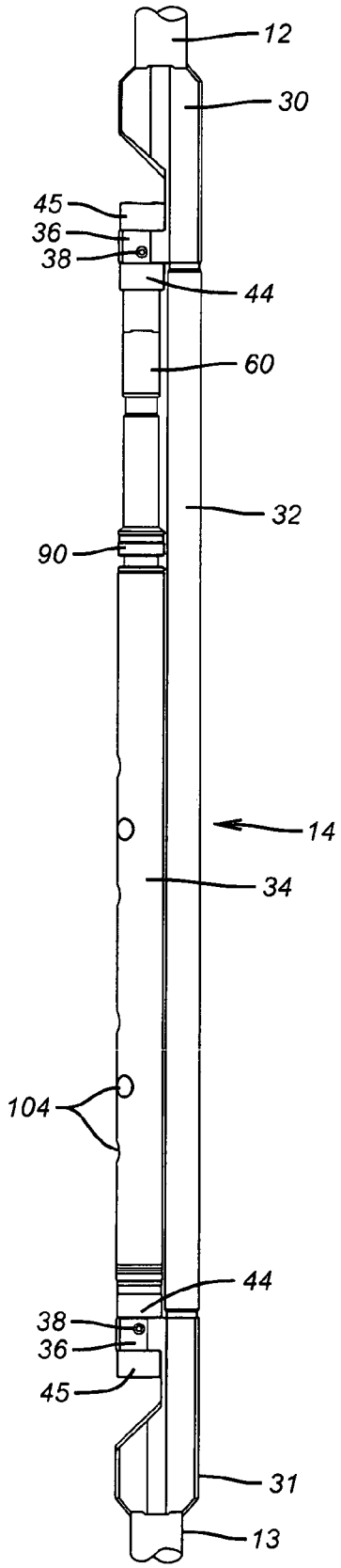
FIG. 2 is a side profile view of the present perforation assembly.

The construction and assembly elements of a perforation assembly 14 shall be described in greater detail with respect to FIG. 2-11. The general organization of the perforation assembly 14 is shown by FIG. 2 to include identical upper and lower Y-adapters 30 and 31, respectively. The threaded pipe connection box 50 in each of these Y-adapters receives the threaded pin end of a production tube 12 or connector sub 13. See FIG. 2. Both Y-adapters are linked together by a circulation mandrel 32. Relative to FIG. 10, the pipe connecting box bores 50 of the Y-adapters are open to fluid flow with the adapter lateral bores 52. The threads of the opposite pin ends of the mandrel 32 are turned into the mandrel connecting box threads in the lateral bore 52 for fluid flow continuity from the lateral bores 52 along the mandrel bore 54.

Each Y-adapter also includes a structurally integral receptacle collar 36. Each receptacle collar is bored along an axis parallel with the axis of mandrel 32 to provide a gun confinement aperture. The perforation gun assembly 34 is secured within and between these receptacle collars 36. Both of the collars 36 have one or more, three in this example, apertures 38 bored radially relative to the collar bore 36 axis. These apertures 38 serve as confinement sockets for socket screw heads, the threaded shafts of which are turned into the perforating gun structure to secure the angular orientation of the gun assembly 34 about the gun assembly axis.

Figure 3:
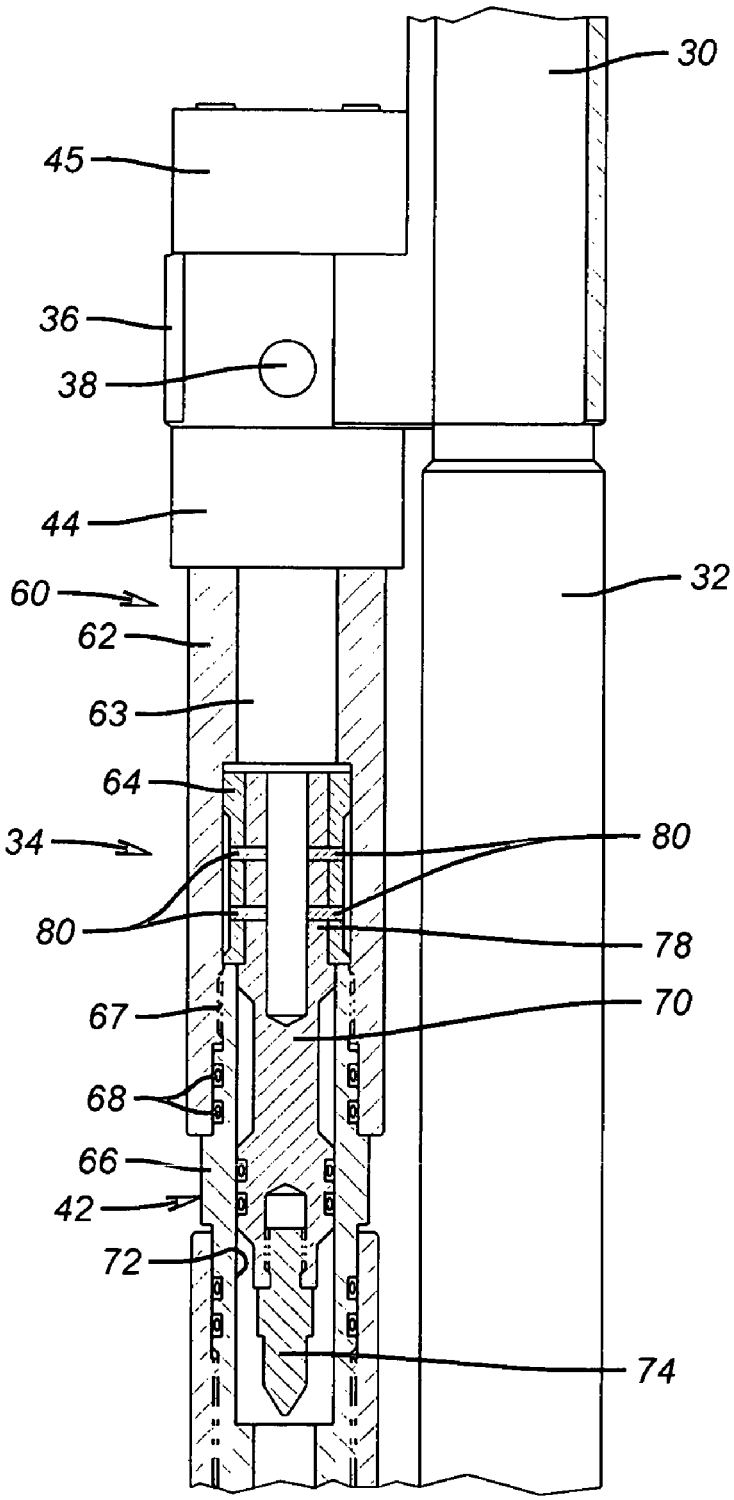
FIG. 3 is a partially sectioned view of the upper end of the perforation assembly.

With particular reference to FIG. 3, the perforation gun assembly may include a firing head assembly 60 comprising an adapter sleeve 62 having an internal bore opening 63 and a threaded external shaft that receives the internally threaded locking rings 44 and 45. With the sleeve 62 penetrating the confinement bore of the collar 36, the two threaded locking rings 44 and 45 are turned tightly against the opposite abutment faces of the collar 36 to secure the desired longitudinal position of the gun assembly relative to the Y-adapter 30.

The lower end of the adapter sleeve 62 is provided with a stepped boring. The deeper, smaller I.D. bore receives a shear pin set sleeve 64. The axial position of the set sleeve 64 is confined by the distal end of the firing pin cylinder 66. The firing pin cylinder 66 is threaded at 67 to the adapter sleeve 62. O-ring seals 68 environmentally protect the assembly interior at this point. A firing pin piston 70, slideably disposed within the internal bore 72 of the firing pin cylinder 66, carries a firing pin 74 at its lower distal end and the shear pin skirt 78 at its upper end. The shear pin skirt is dimensioned to a close sliding fit within the internal bore of set sleeve 64. Shear pins 80 bridge the cylindrical interface between the skirt 78 and the set sleeve 64 to restrain the arm position of the firing pin piston until sheared by sufficient fluid pressure against the upper sectional area of the piston 70.

Figure 4:
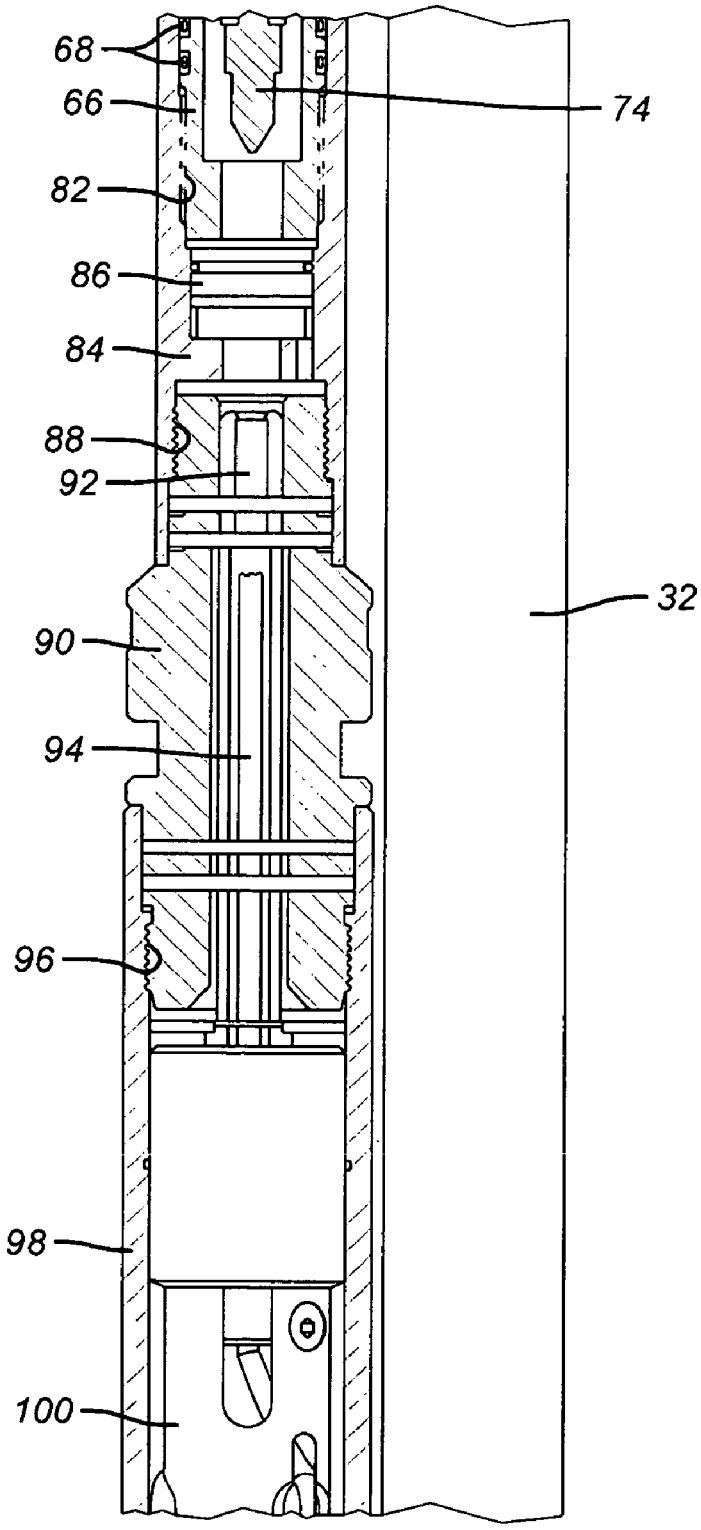
FIG. 4 is a partially sectioned view of the firing body portion of the perforation gun

The lower end of the firing pin cylinder 66 is shown by FIG. 4 to have a threaded engagement 82 with a firing body 84. The lower distal end of the firing pin cylinder confines a percussion initiator 86 within a firing body bore against an internal bore shoulder. The firing body 84 is attached by threads 88 to a bi-directional booster assembly 90 which confines the assembly interface between a detonation booster cartridge 92 and a detonation cord 94. The lower end of the booster assembly is attached by threads 96 to a perforating gun housing 98.

Figure 5:
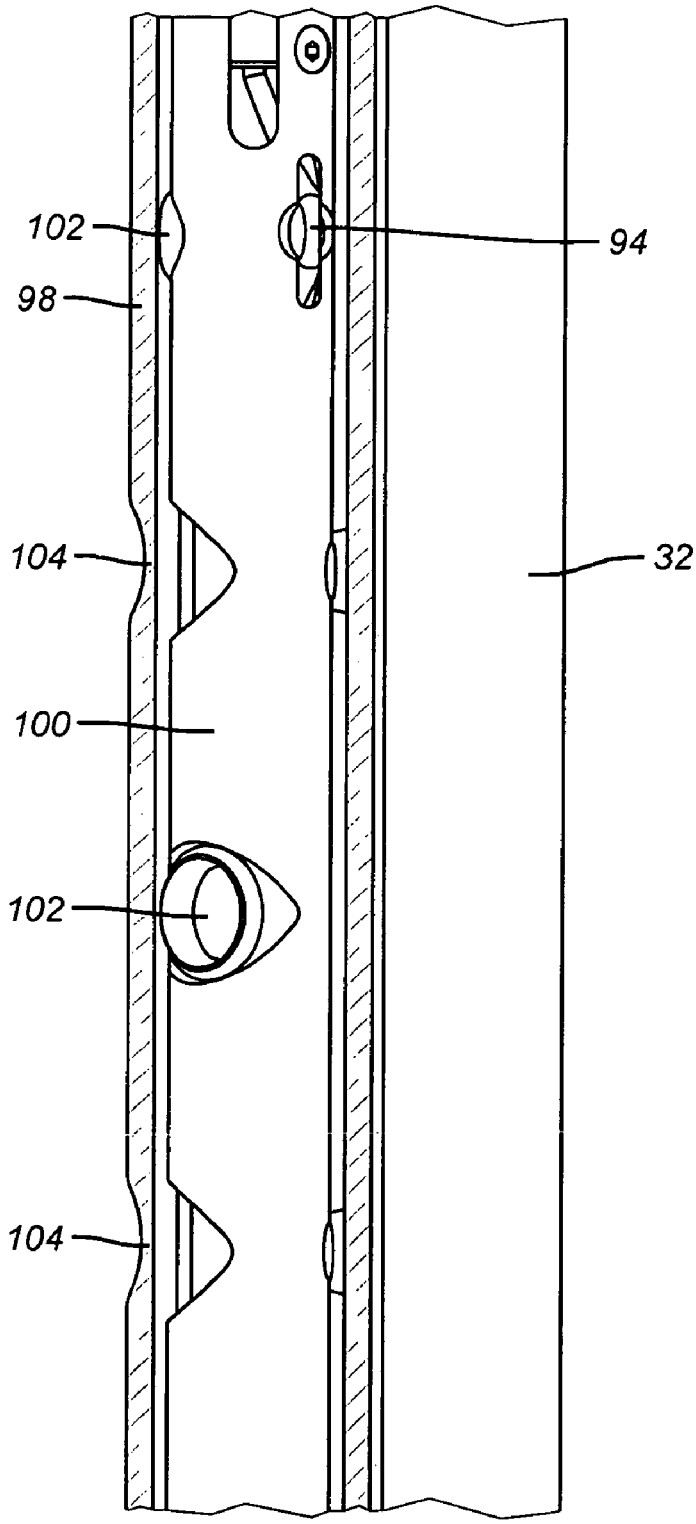
FIG. 5 is a partially sectioned view of the perforation gun.
Figure 6:
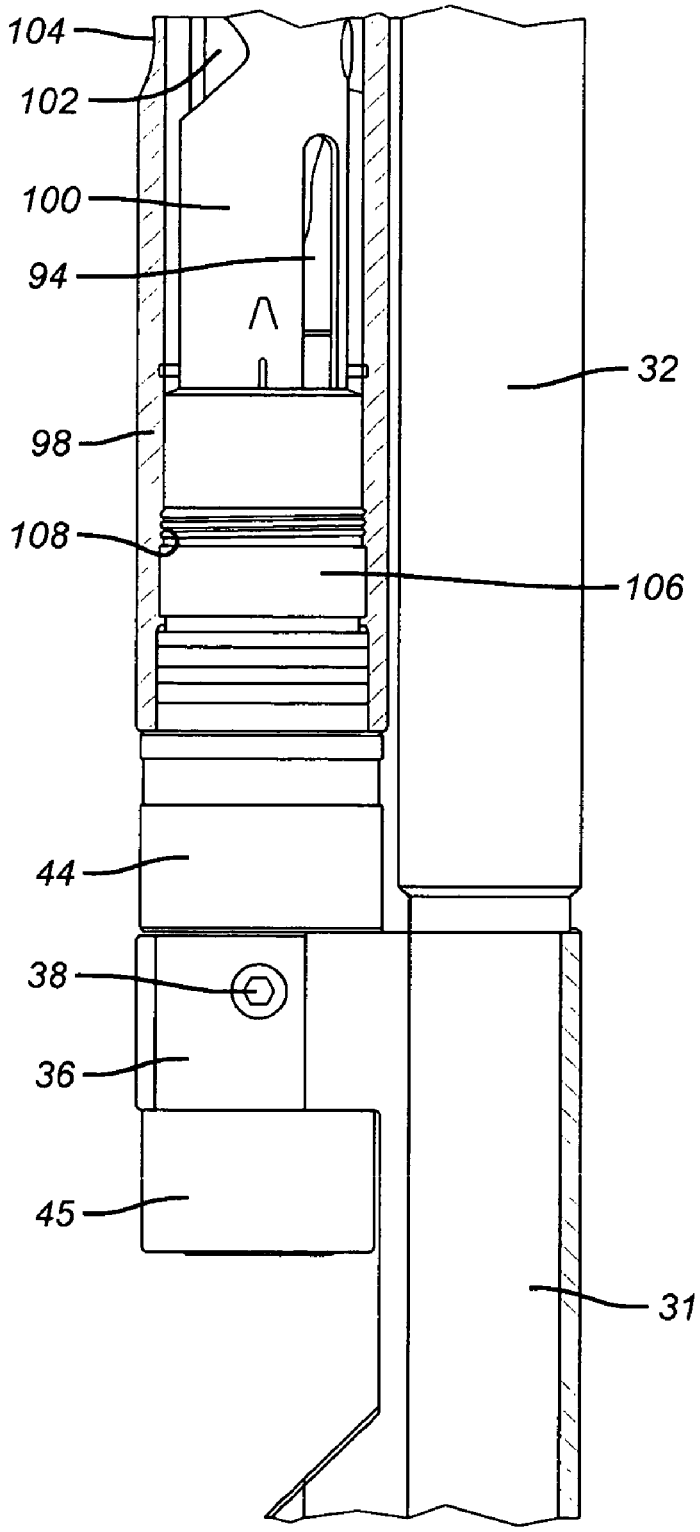
FIG. 6 is a partially sectioned view of the bottom end of the perforation gun.

FIG. 5 shows the gun housing 98 as protectively confining a charge holder tube 100. Distributed along the length of the charge holder tube is a plurality of shaped explosive charges 102 set in holder tube sockets. The discharge axes of the charges are set at various radial angles from the holder tube axis within a limited arc that prevents the shaped charge discharge jets from damaging the circulation mandrel 32. The detonation cord 94 is threaded along the charge holder tube length to serially engage each of the shaped charge bases. Traditionally, the gun housing 98 wall is weakened with scallops 104, for example, at selected locations in radial opposition from the shaped charges 102.

Figure 7:
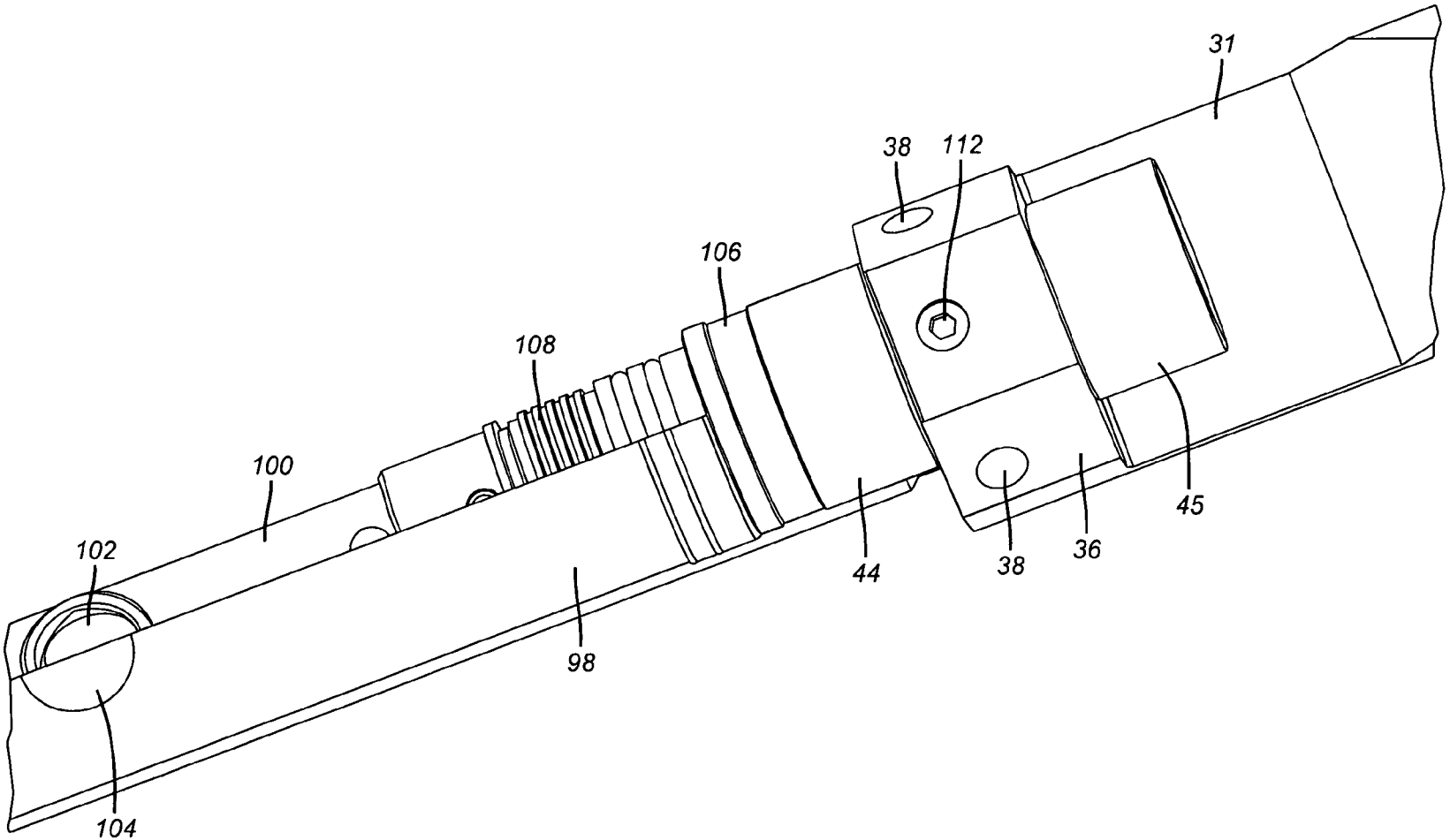
FIG. 7 is a detailed and partially sectioned view of the bottom Y-adapter and perforating gun.
Figure 8:
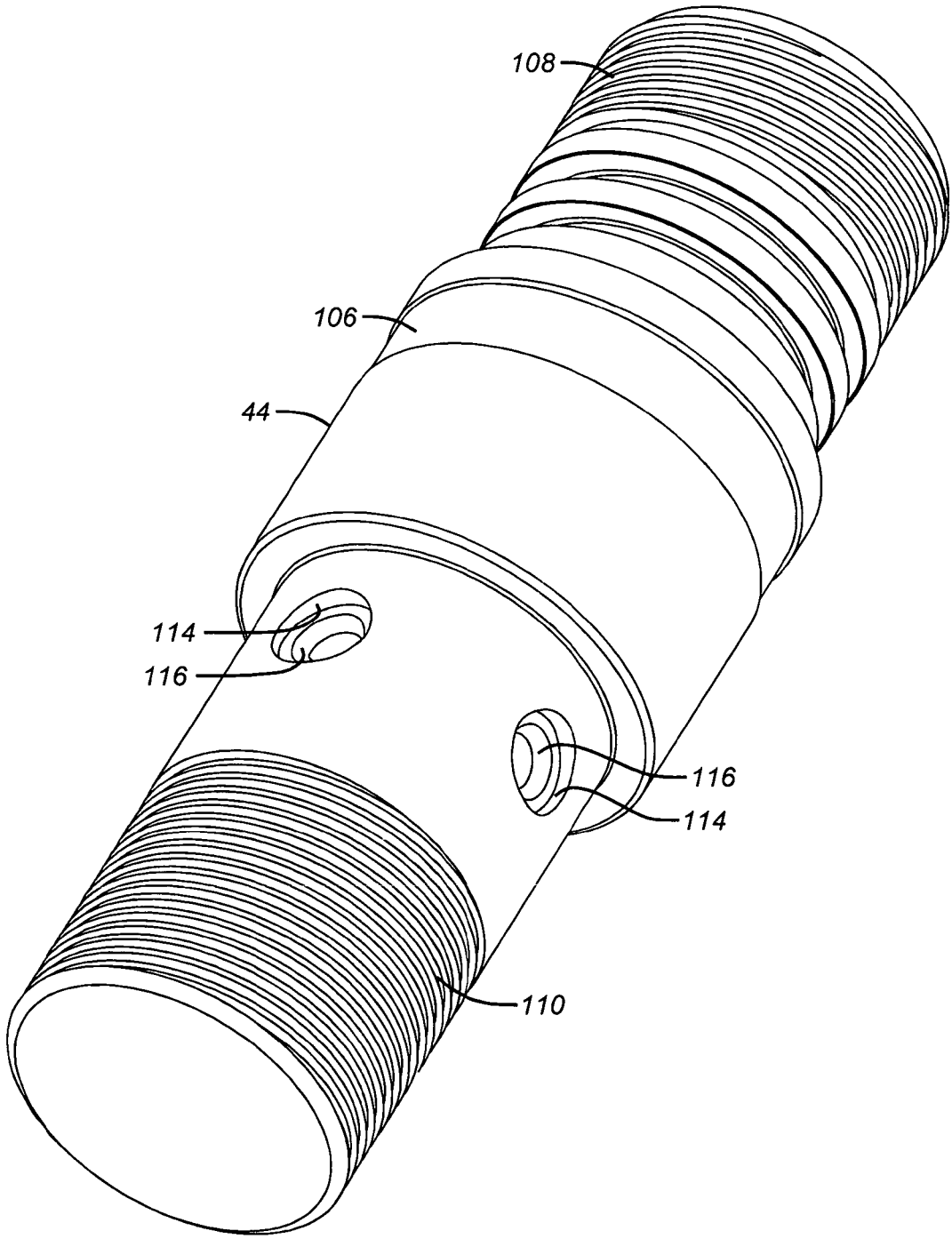
FIG. 8 is a pictorial view of the gun bottom bull plug.
Figure 9:
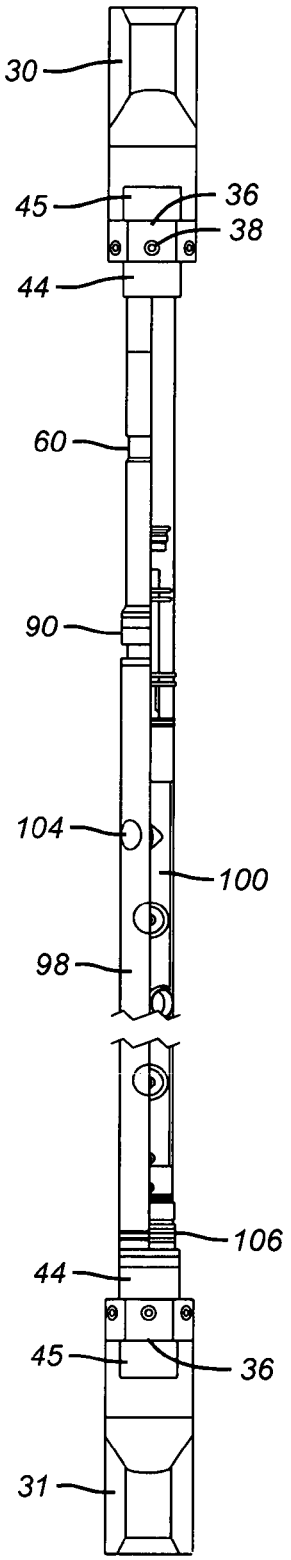
FIG. 9 is a partially sectioned plan view of the perforation assembly.
Figure 10:
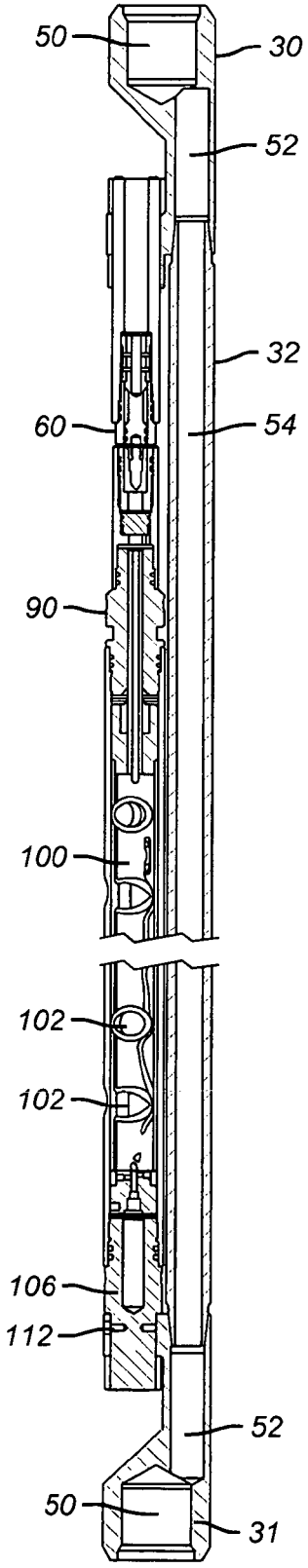
FIG. 10 is a side view of the perforation assembly in full cross-section.
Figure 11:
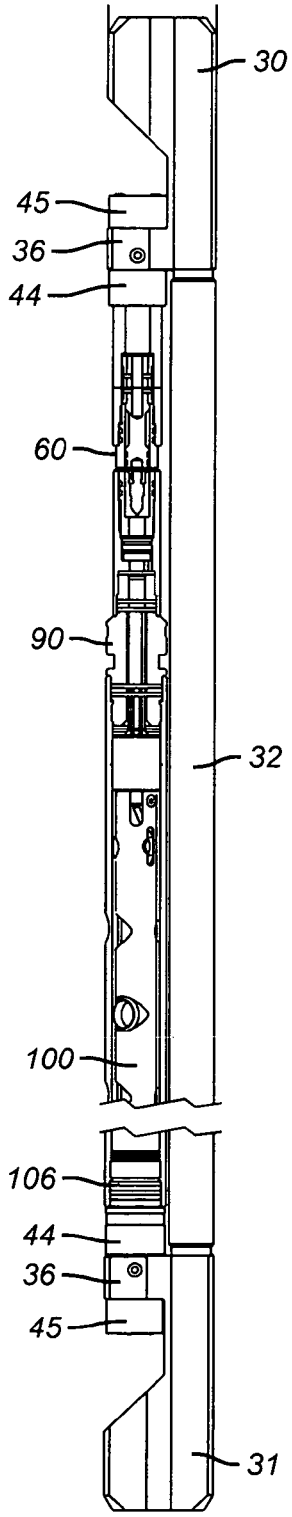
FIG. 11 is a side view of the perforation assembly showing the perforating gun in cross-section.

The bottom end of the gun housing 98 is closed with a solid material bull plug 106 attached to the gun housing internal bore by threads 108. O-rings seal the bore and shaft assembly interface. Referring to FIGS. 7 and 8, the external shaft of the bull plug is threaded 110 to receive threaded locking rings 44 and 45. Additionally, the external shaft is counter-bored 114 at selected radial angles around the circumference for socket-head set screws 112. The inner bore 116 is threaded to receive the socket screw shaft whereas the outer bore is smooth to receive a portion of the socket screw head. A half portion of the socket screw head height projects into the sockets 38 in the receptacle collar 36 to prevent rotation of the gun assembly 34 relative to the receptacle collar 36.

Operation

The pipe string 10 is assembled substantially according to the schematic of FIG. 1 with the bit and scraper 16 on the wellbore bottom and a sufficient length of spacer tube 12 above the bit 16 to the first production zone. One or more joints of perforation assembly 14 continue the string 10 along the first production zone. If additional production zones are traversed by the wellbore, additional spacer tube 12 is provided to the next production zone. More perforation assemblies are added to the string in sufficient number to traverse the next production zone. The number of perforation assembly groups will depend on the number zones to be produced.

With the bit 16 at or near the wellbore bottom, clean fluid is circulated through the tubing and circulation mandrels of the perforation assembly and up through the annulus 20 between the pipe string 10 and the casing 18 bore wall. Conversely, fluid may be reverse circulated by being pumped down the annulus 20 and back up the pipe string.

This circulation process is continued until the operator is satisfied with the degree of debris flushing accomplished. When the flush circulation is complete, the pipe string 10 is positioned to align the perforation assemblies with the corresponding geologic production zones. With all other preparations complete, the fluid pressure within the wellbore is raised, usually by control of the circulation pumps, to the predetermined value for shearing the pins 80. In particular, the wellbore fluid pressure bearing against the cross-sectional area of the firing pin piston 70 is raised until the net force value of the fluid pressure on the piston 70 overcomes the shear strength of the shear pins 80. This pressure value will be characterized here as the detonation pressure.

When the detonation pressure is reached, the firing pin piston drives the firing pin 74 into the percussion initiator 86. Impact of the firing pin against the percussion initiator 86 activates shock sensitive compounds within the percussion initiator which decompose explosively. In turn, the hot explosive gases of the percussion initiator 80 activate the detonation booster 92 which ignites the detonation cord 94.

The detonation cord 94 is connected along its length to the base of each shaped charge 102. Upon ignition by the booster 92, a deflagration front travels the length of the detonation cord 94 to successively ignite each of the shaped charge 102. Resultantly, a jet of hot gas and molten material erupts from the shaped charges to pierce the casing 18, any surrounding cement collar and a limited distance into the geologic formation forming the production zone. The production zone penetration channel created by the shaped charge jet serves to increase the area of fluid production face from the production zone. Such fluid production follows the channel through the casing wall perforation into the wellbore annulus. The fluid production may be extracted at the surface from either the wellbore annulus or from the pipe string 10 flow bore which remains in place for production.

Supplementally, after the casing and production zone perforation, well treating frac-fluid such as zone specific formation fracturing acid or proppant comprising fluidized particulate or sand mixtures may be pumped down either the pipe string bore or the wellbore annulus to enhance the perforation channel productivity. Following the frac-fluid treatment, the well may be flushed with clean circulation fluid initially or again if flushed previously.

Throughout these several well preparation processes, the pipe string has remained in place. When the last procedure has been completed, the well pressure is allowed to return to the natural state and the in situ formation fluid allowed to enter the casing bore through the perforations. Formation fluid may be extracted from either the well bore annulus or the production tube. In the latter case, the in situ fluid enters the production tube bore from the casing annulus through the bit 16 jet apertures.

Although the invention has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention. Directional orientation terms such as "upper", "lower". "up" and "down" are not to be to be interpreted as terms of operational limitations but only as descriptive devices for facilitating Applicants' invention disclosure.

The invention claimed is:

1. A well completion apparatus comprising:

(a) a pipe string having a continuous fluid flow channel along a length thereof;

(b) an earth boring bit secured to a distal end of said pipe string;

(c) perforation means comprising gun means and a fluid flow mandrel secured at opposite distal ends between Y-adapter means at selected locations along said pipe string length for perforating a wellbore casing, said fluid flow mandrel for channeling fluid flow past said gun means toward said boring bit, each of said Y-adapter means having a threaded assembly with an adjacent pipe section and a threaded assembly with respective distal ends of said fluid flow mandrel, each of said Y-adapter means having collar means to encompass respective distal ends of said gun means and secure a substantially parallel axis alignment between said gun means and said flow mandrel, said gun means having a plurality of shaped charges distributed along a length thereof;

(d) a pair of locking rings threaded upon respective ends of said gun means and turned against opposite faces of said collar means to secure a predetermined longitudinal position of said gun means between said collar means; and, (e) means for detonating said shaped charges by a predetermined detonation pressure.

2. A well completion apparatus as described by claim 1 wherein said pipe string further includes pipe bore scraping means.

3. A well completion apparatus as described by claim 1 wherein a leg of said Y-adapter comprises an internally threaded pipe connecting box and one arm of said Y-adapter comprises an internally threaded mandrel connecting box, a fluid flow channel within said Y-adapter links said pipe connecting box with said mandrel connecting box.

4. A well completion apparatus as described by claim 1 wherein pins secured to said gun means project into apertures in said collar means to prevent rotational movement of said gun means about an axis of said gun.

5. A well completion apparatus as described by claim 1 wherein said means for detonating comprises a percussion initiator and restrained piston means for explosively activating said percussion initiator.

6. A well completion apparatus as described by claim 5 wherein said piston means comprises shear pin means for restraining said piston means from activating said percussion initiator at a wellbore fluid pressure that is less than a predetermined shear pin failure pressure.

7. A method of assembling a well completion string comprising the steps of:

providing an axially elongated perforation gun having threaded distal end pins and shaped perforation charges distributed along the length thereof;

providing an axially elongated fluid flow mandrel having threaded distal end pins;

providing a pair of Y-adapters having threaded pipe boxes and threaded mandrel boxes, said Y-adapters also having collars bored to receive the distal ends of said perforating gun;

turning the pipe boxes of said pair of Y-adapters onto pin ends respective to adjacent pipe sections;

turning the threaded mandrel boxes onto said mandrel end pins;

inserting said perforating gun ends into said pair of Y-adapter collar bores to align said gun axis in parallel with said mandrel axis; and, securing a longitudinal position of said perforating gun between said Y-adapter collars by turning threaded locking rings on said gun end threads against said Y-adapter collars.

8. A method as described by claim 7 wherein said perforating gun is secured from rotating about the axis of said gun by securing pins through said Y-adapter collars into said gun ends.

9. A method as described by claim 7 wherein said shaped perforating charges are detonated by wellbore pressure.

* * * * *